United States Patent [19]

Pethö et al.

[11] Patent Number: 4,987,726

[45] Date of Patent: Jan. 29, 1991

[54] BOTTLE FILLING AND SEALING APPARATUS

[75] Inventors: Lajos Pethö; Ivan Håkansson; Lennart Månsson, all of Limoges, France

[73] Assignee: KabiVitrum AB, Stockholm, Sweden

[21] Appl. No.: 377,860

[22] PCT Filed: Dec. 2, 1988

[86] PCT No.: PCT/SE88/00661

§ 371 Date: Jul. 6, 1989

§ 102(e) Date: Jul. 6, 1989

[87] PCT Pub. No.: WO89/05277

PCT Pub. Date: Jun. 15, 1989

[30] Foreign Application Priority Data

Dec. 4, 1987 [SE] Sweden ..... 8704863

[51] Int. Cl.[5] ..... B67C 7/00; B67C 3/02

[52] U.S. Cl. ..... 53/510; 53/90; 53/95; 53/281; 53/425

[58] Field of Search ..... 53/425, 426, 432, 405, 53/408, 403, 510, 79, 91, 90, 86, 281, 282, 276, 275, 274, 485, 471; 141/179, 178, 129

[56] References Cited

U.S. PATENT DOCUMENTS

| | | | |
|---|---|---|---|
| 2,763,107 | 9/1956 | Day et al. | 53/90 X |
| 3,431,702 | 3/1969 | Spaulding | 53/281 |
| 3,707,823 | 1/1973 | Guckel | 53/91 X |
| 4,514,953 | 5/1985 | Patzwahl | 53/510 X |
| 4,538,399 | 9/1985 | Müller | 53/95 X |
| 4,655,029 | 4/1987 | Weiss | 53/510 X |

FOREIGN PATENT DOCUMENTS

| | | |
|---|---|---|
| 0012429 | 6/1980 | European Pat. Off. . |
| 2045132 | 2/1971 | France . |
| 2444001 | 7/1980 | France . |
| 133668 | 11/1951 | Sweden . |
| 335900 | 6/1971 | Sweden . |
| 341620 | 1/1972 | Sweden . |
| 684057 | 12/1952 | United Kingdom . |
| 1560361 | 2/1980 | United Kingdom . |
| 2160182 | 12/1985 | United Kingdom . |

*Primary Examiner*—James F. Coan

*Attorney, Agent, or Firm*—Pollock, Vande Sande & Priddy

[57] ABSTRACT

An apparatus for aseptically filling and sealing bottles with a liquid preparation includes a plurality of treatment stations in which bottles are successively placed in bottle holding devices, evacuated and flushed or rinsed with an inert gas, filled with the liquid preparation, sealed and removed from the bottle holding devices, all in a system which is sealed from the exterior. The transporting system is adapted to provide a successive, relative movement between the bottles in the holding devices and the treatment stations. The system, which is sealed from the exterior, is provided with known sealing lock arrangements for the sterile introduction of empty bottles, liquid preparation and connections for the discharge of filled and sealed bottles, all while maintaining sterile conditions in the apparatus.

20 Claims, 10 Drawing Sheets

WEIGHT GAIN IN RATS, TO WHICH HAS BEEN INFUSED A CONVENTIONALLY BOTTLED AMINO ACID SOLUTION WITH GLUCOSE (A) AND THE SAME SOLUTION BOTTLED ASEPTICALLY (B)

BOTTLE FILLING AND SEALING APPARATUS

The present invention relates to a bottle filling and sealing apparatus, and more specifically, but not exclusively, to an apparatus for filling and sealing bottles aseptically.

Pharmaceutical preparations which are made available to the consumer must be as free as possible from contaminating microorganisms and contaminating particles. This is particularly true of preparations which are intended for parenteral administration, such as injection and infusion preparations, and which must be completely sterile when used, in order to avoid serious side effects and secondary infections.

By sterile conditions a total absence of microorganisms is meant, and accordingly a sterile product is one which is completely free from microorganisms. By aseptic conditions is also meant the absence of microorganisms, and these two terms are therefore practically synonymous. It is possible at times, however, to speak of greater or lesser degrees of asepticity, and then to refer to a degree of freedom from microorganisms which is sufficient for the purpose intended. The object of this invention, however, is to achive complete sterility both with the method and in the final product.

The easiest method to achieve sterility with pharmaceutical preparations, and also the one most often applied, is to heat the preparations to a sufficiently high temperature, normally to about 120° C. or above. The death of infectious microorganisms can be ensured at such temperatures, if sustained over a sufficiently long period of time. Heat sterilization is normally carried out on the finally packaged preparations, and since the packages are satisfactorily sealed, there is no reinfection of the contents subsequent to cooling.

There are many instances however, when heat sterilization is less suitable, since it results in a detrimental change in the structure or properties of certain pharmaceutical preparations. For instance, sensitive components can be broken-down or degraded and proteins can be denatured. Preparations in the form of emulsions or suspensions can be affected so as to cause the different phases present to separate. Another example resides in nutrient infusion preparations which include a mixture of amino acids and carbohydrates. When such mixtures are heated, Maillard reactions are likely to occur and form reactions products which may be toxic and which in all events will impair the quality and nutrient value of the product.

In those instances when it is not possible to heat sterilize the end product, a sterile product can be still obtained nevertheless, by sterilizing the preparation from the outset and by packaging the product in sterile packages under sterile or aseptic conditions. When sterile conditions are maintained during the entire process, the final product will also be obtained as a sterile preparation packed in a protective package. If the packaging process has been carried out at a sufficiently low temperature, no unfavorable change will have taken place in the product.

Although this sterile packaging has been known for a long time, it cannot be put into practice without encountering great difficulties, due to the extremely high sterility demands placed on pharmaceutical preparations which are intended for parenteral administration. This also applies to the provision of a process which can be practiced economically on an industrial scale while maintaining rigorous safety.

The most common case in this respect is on which entails filling bottles with a liquid preparation. Such processes require the bottles used to be sterilized and the air therein to be expelled with an inert, sterile gas, so as to avoid oxidation, whereafter the bottles are filled with the liquid preparation in the complete absence of subsequent droplets or splashes and then sealed with stoppers or caps, all of these procedural steps being effected while maintaining sterile or aseptic conditions. Although an apparatus which will enable such bottling processes to be carried out quickly, reliably and economically is highly desirable, such an apparatus is not yet available. This deficiency is now rectified by the present invention.

SUMMARY OF THE PRESENT INVENTION

Accordingly, the present invention provides an apparatus which is intended for the sterile filling and sealing of bottles with a liquid preparation and which includes (a) a station in which the sterile bottles are placed into holding devices and the air present in the bottles is displaced therefrom with the aid of an inert gas;

(b) a station in which the bottles are placed under a pressure which is lower then ambient pressure and flushed with an inert gas;

(c) a station in which the bottles are filled with a desired liquid preparation;

(d) a station in which the filled bottles are sealed by means of sterile stoppers and/or caps;

(e) a station in which the filled and sealed bottles are removed from the movable bottle holding devices; and (f) a transporting arrangement by means of which a successive relative movement is achieved between the bottles in the holding devices and the stations (a)-(e); wherein the stations (a)-(e) and the transporting arrangement (f) are enclosed in a pressure-tight casing such that the entire apparatus will form a closed system provided with lock-type seals for the sterile infeed and outfeed of material and products.

The stations will preferably be arranged in a cycle or linear path and the stations (a) and (e) will preferably be one and the same station, such that the filled and sealed bottles are removed from and the empty bottles introduced to the system at one and the same station. However, in principle there is nothing to present the filled and sealed bottles from being removed from the production system at two mutually separate, successive stations.

The transporting system will preferably be constructed so that the holding devices, with bottles, will be moved successively from station (a) to station (e), these stations being stationary. The system, however, may also be such that the locations of the holding devices are fixed and that the various treatment stations (a) to (e) are moved so that the bottles carried by the holding devices will be subjected to the treatment stages in succession. The invention and preferred embodiments thereof will become more apparent from the following detailed description, which is made with reference to the accompanying drawings, which are not intended to limit the scope of the invention, however.

BRIEF DESCRIPTION OF THE DRAWINGS

In the accompanying drawings

In the drawings, like elements have been identified with the same reference numerals.

FIGS. 1-3 illustrate an apparatus comprised of a frame structure 1 which carries a robust and strong mounting plate 2. Arranged beneath the plate 2 is a container 3 in which filling and stoppering of the bottles takes place. The container 3 is detachably connected to the plate 2 and can be lowered down and rolled forwards on wheels 4. This permits ready access to the container interior and to the undersurface of the plate, for maintenance, cleaning and sterilizing purposes. Sterilization and cleansing of the apparatus, however, is intended to be carried out with the apparatus in its assembled state, and the apparatus is constructed to this end.

Figure 1:
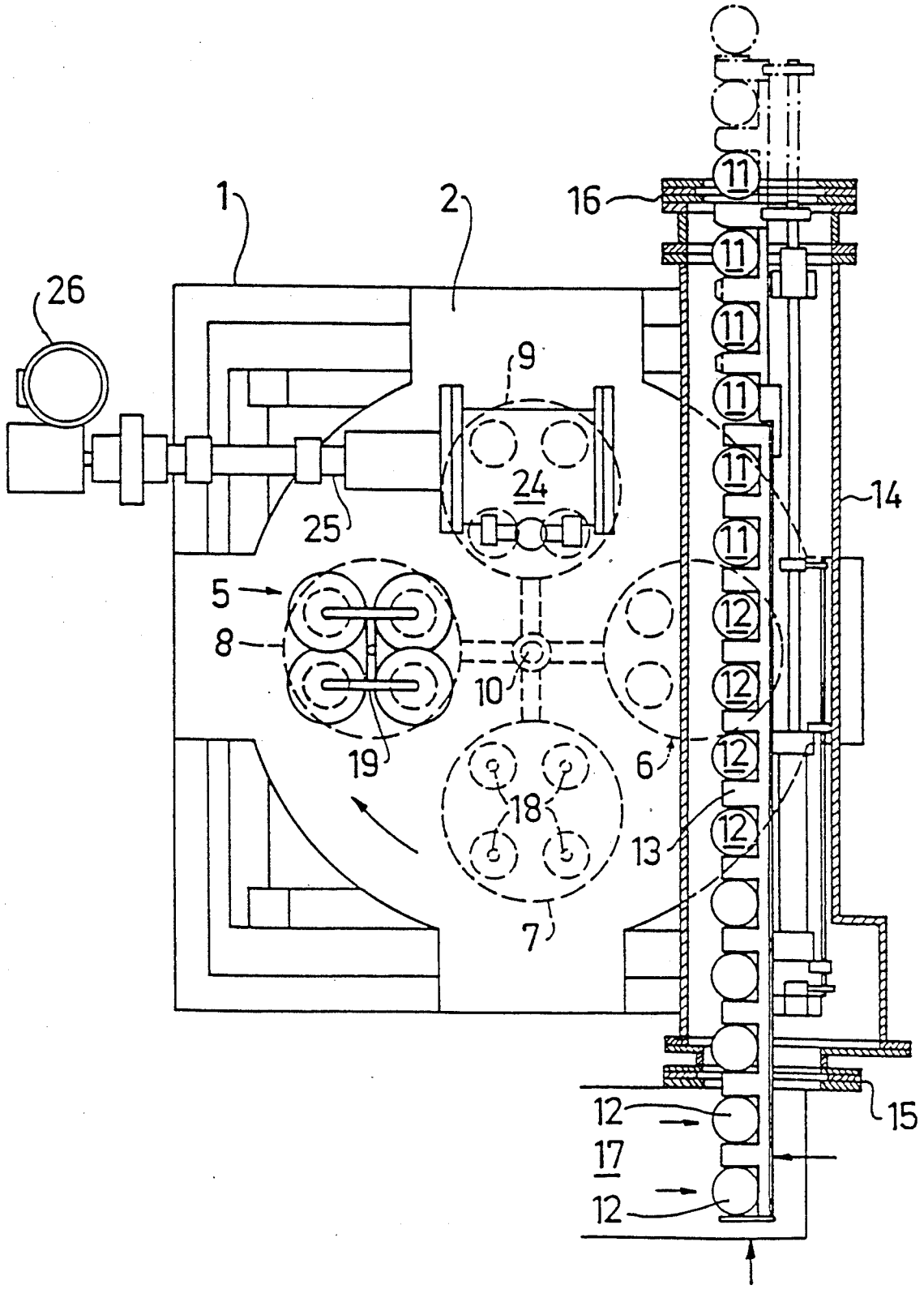
FIG. 1 is a schematic top view of an apparatus constructed in accordance with the present invention.
Figure 2:
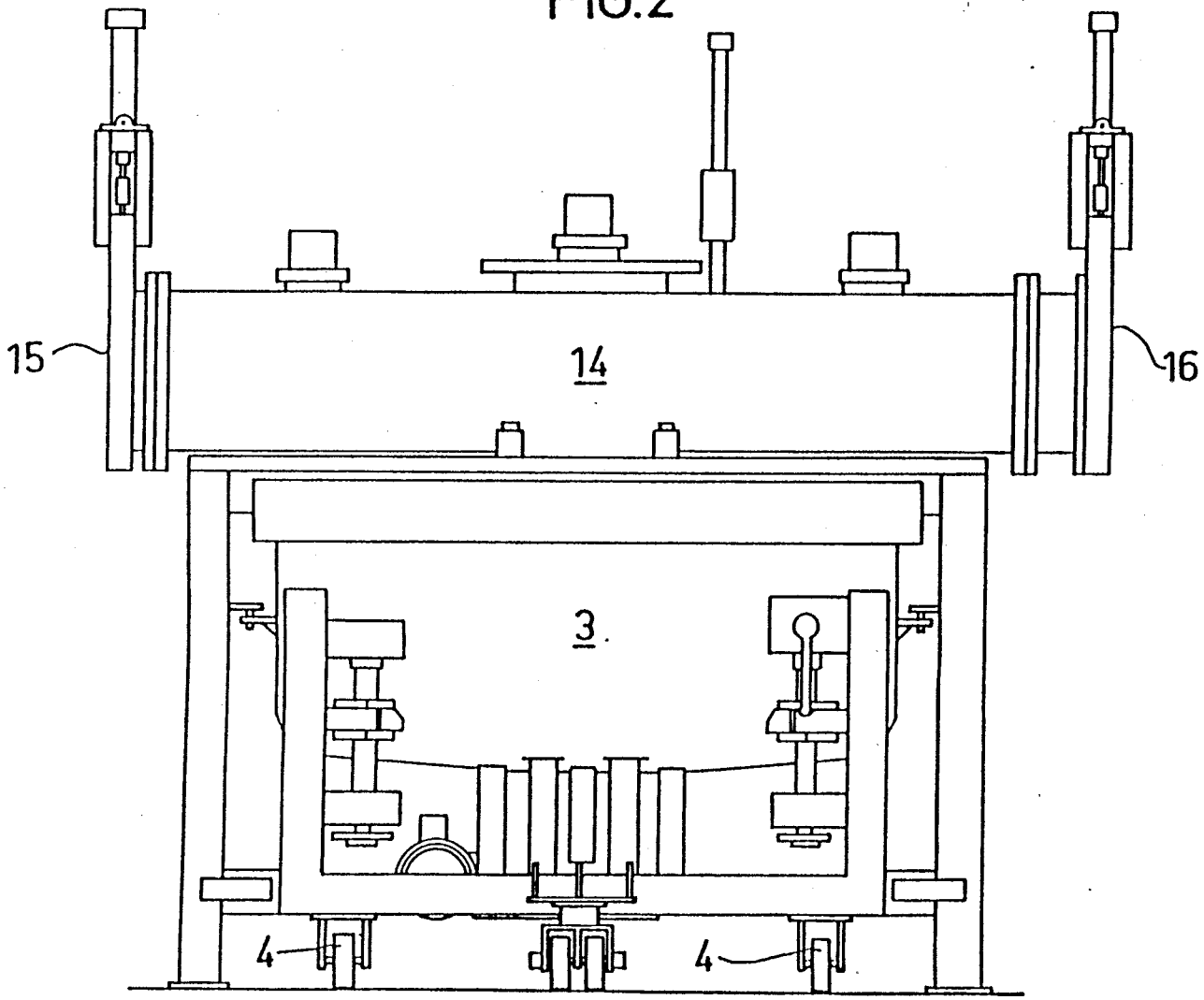
FIG. 2 is a schematic front view of the apparatus.

Located on the plate 2 are preferably four treatment stations 6, 7, 8 and 9, in which the respective stages of filling and sealing the bottles are carried out.

The container 3 has arranged therein a bottle transporter 5.

The transporter 5 is configured as a carrousel having preferably four positions 6, 7, 8, 9, each located at a respective end of an arm extending from the center shaft 10 of the large carrousel. The center shaft extends vertically through the bottom of the container 3 and is driven via a disengageable clutch forming part of a suitable drive means (not shown).

Each of the carrousel positions or locations 6, 7, 8, 9 is in itself a smaller carrousel which includes holding devices for a pluarlity of bottles, of which four are shown in the drawing. It will be understood that other numbers are possible. The smaller carrousels can be caused to rotate in a regular fashion, independently of the rotation of the larger carrousel, with the aid of known drive means (not shown).

In the illustrated, preferred embodiment, filled and sealed bottles 11 are removed from and empty sterile bottles 12 are placed in the larger carrousel at the station 6. The bottles are removed and inserted by means of a movable, comb-like gripping device 13. The gripping device 13 is disposed in a tunnel 14 which is connected to the container 3 and the treatment station 6 for the removal and insertion of bottles, through suitable cut-outs or apertures in the plate 2. The ends of the tunnel 14 are also connected, by means of suitable connections 15, 16, with a supply tunnel 17 for empty bottles taken from a sterilizing arrangement (not shown) and with a means for discharging filled and sealed bottles. Also arranged in the tunnel is a device for fitting sterile sealing caps over the stoppers in the filled and stoppered bottles. This device may be of any known conventional design and is not therefore shown in detail. Both the supply tunnel and the discharge or outfeed means are provided with a known sealing lock arrangement (not shown) for maintaining sterility and a suitable pressure in the container 3 and the tunnel 14.

The tunnel 14 is also provided with an inert gas inlet (not shown) by means of which the empty bottles are flushed or rinsed initially with inert gas, so as to displace the air present therein, prior to being lowered into the holding devices on the carrousel in the station 6.

In the treatment station 7, the plate 2 is provided with connections 18 which are intended for establishing a partial vacuum and through which inert gas is introduced for further flushing or rinsing of the bottles, which is effected by alternately placing the bottles under vacuum and alternately flushing or rinsing the bottles with an inert gas.

In the treatment station 8, the plate 2 is provided with connecting lines 19 intended for delivering the liquid preparation to the bottles to be filled with this preparation. The actual filling procedure is described in more detail hereinafter.

An arrangement for stoppering the filled bottles is located in the treatment station 9. The stoppering arrangement includes a magazine for storing and orientating sterile stoppers, delivered to the magazine from a sterilizing device. In some embodiments, the magazine itself may also form the stopper sterilizing and orienting arrangement, thereby simplifying the construction of the apparatus. The arrangement also includes a delivery line 20 for delivering the orientated stoppers, a detecting and sorting arrangement 21 for detecting faulty stoppers and rejecting stoppers of wrong dimensions, and a distributing device 22 incorporating a guide path 23 for feeding the orientated and sorted stoppers to two or more stopper lines which extend to the actual stoppering arrangement, generally referenced as 24. The stoppering arrangement includes a rotor which is driven intermittently by a motor 26 via a shaft 25. The entire arrangement for orientating and sorting the stoppers and for inserting the stoppers into respective bottles in enclosed in a pressure-tight casing, which is connected to the plate 2 in a pressure-tight manner and which is in connection with the bottles in the treatment station 9 through an aperture or cut-out in the plate 2. The stoppering arrangement will be described in more detail hereinafter.

The apparatus is also provided with the requisite connections for conduits intended for carrying inert gas under pressure, establishing vacuum conditions, carrying steam for sterilizing purposes, washing liquid etc., all of which will be obvious to one skilled in this art. These connection are therefore not shown in detail.

Figure 4:
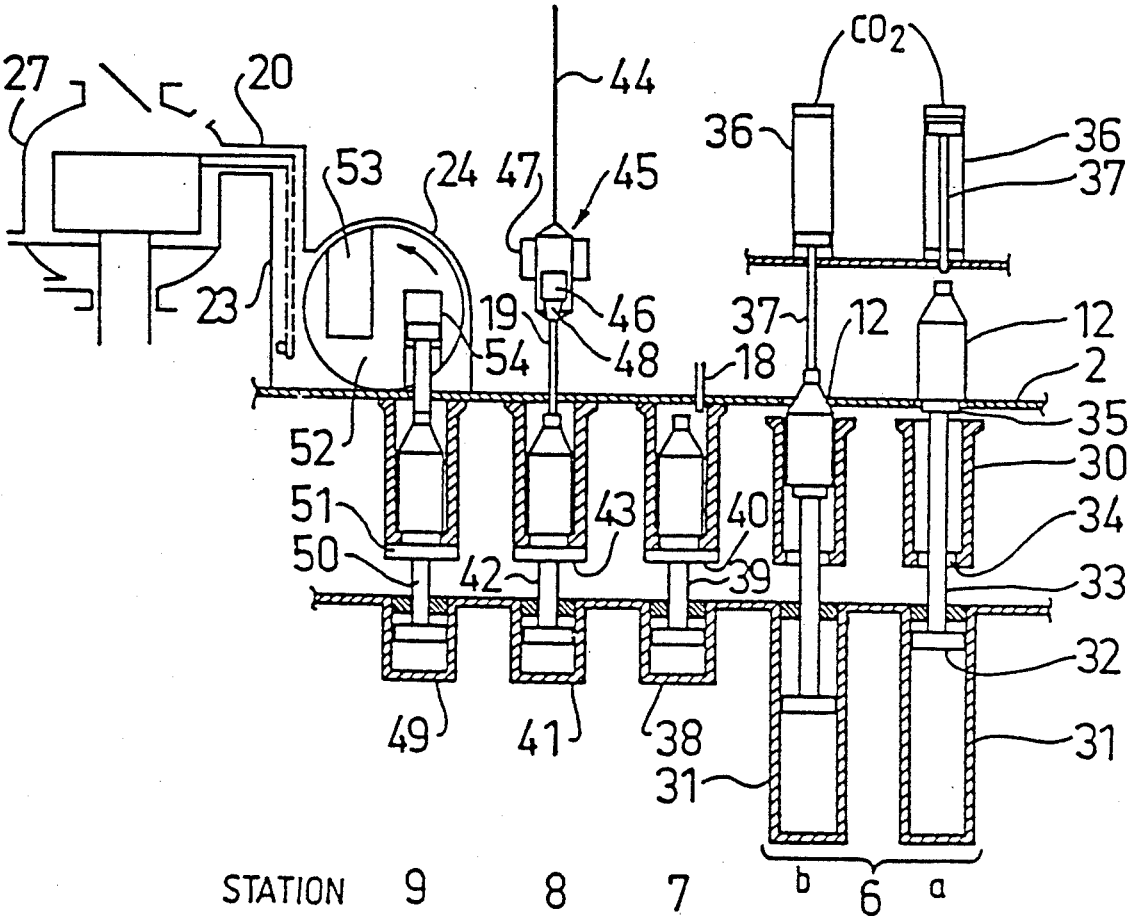
FIG. 4 is a principle illustration of the various procedures of the bottle filling process.

FIG. 4 illustrates schematically the operation of the apparatus at the various treatment stations. It will be seen that the bottle holding devices, disposed in the smaller carrousels, have the form of cylindrical sleeves 30 which can be connected to the mounting plate 2 in a gas-tight fashion, this gas seal being ensured with the aid of packing glands (not shown) located at the upper edges of the sleeves. Arranged beneath two of the bottle locations corresponding to the station 6 are pneumatic piston-cylinder devices 31 comprising pistons with piston rods 33 which extend through openings 34 in respective bottoms of the cylindrical sleeves 30 and which are terminated by carrier plates 35. When an empty bottle 12 is advanced to the station 6, a carrier plate 35 will be located in its uppermost position and therewith support the bottle, as shown by the position *6a*. The piston is then lowered, retracting the piston rod 33 so that the bottle is lowered withdrawn into the cylinder, so as to finally rest on the bottom thereof, as illustrated at *6b*. The carier plate 35 is small enough to pass through the hole 34 in the bottom of the cylinder, whereas the bottle 12 is large enough to rest against the defining rim of the hole 34 in the cylinder bottom.

Also arranged at the station 6 is a device for blowing inert gas into the bottles, so as to displace air present therein, the primary purpose being to purge the bottles of atmospheric oxygen. It comprises a cylinder 36 in which there is mounted a linearly displaceable injection pipe 37 for the injection of an intert gas, such as carbon dioxide or nitrogen gas for example. Injection of the gas is continued while lowering the injection pipe 37 until the bottle is in position in the cylinder 30, whereafter the injection pipe 37 is withdrawn.

Arranged in the following station 7, beneath each bottle location, is a shorter pneumatic piston-cylinder device 38 comprising a piston and a piston rod 39 which is terminated by a plate 40. The plate 40 is larger than the hole 34 in the bottom of the cylinder and forms a seal when pressed against the cylinder bottom. The piston rod 39 together with the plate 40 will also press the whole of the cylindrical sleeve 30 upwardly against the plate 2, so that the upper edge of the sleeve 30 will sealingly abut the undersurface of the plate 2, thereby closing the interior of the sleeve 30 and the bottle 12 from the surroundings in a gas-tight fashion. The bottles can now be alternately placed under vacuum and flushed with an inert gas, preferably nitrogen, through the conduit 18, so as to flush the bottles and remove as much air as possible therefrom.

Subsequent to being flushed or rinsed with inert gas, the bottles are moved to the station 8, where they are filled with the liquid preparation. This station also incorporates a pneumatic piston-cylinder device 41 having a piston and a piston rod 42 and a pressure plate 43 arranged beneath the cylindrical holding sleeve, in the same manner as that described with reference to station 7, so that the cylindrical bottle holding sleeve will also be pressed sealingly against the plate 2 and form a closed space around the bottle. Liquid is introduced through a conduit 44 from a storage tank (not shown) through a valve 45 and the liquid delivery line 19. The valve 45 is provided with a valve plug 46, which is operated by means of a solenoid 47. The valve plug 46 is provided at its lower end with a point 48 which seals against a corresponding seating in the valve housing. The filling station also incorporates a pressure equalizing pipe (not shown) which extends between the cylindrical holding sleeve with bottle and the liquid storage tank so that filling of the bottle can be effected at constant pressure. The pressure equalizing pipe, however, is also provided with a control valve, which enables the gas flow to be controlled during a bottle filling operation. The construction of the bottle filling system will be described in more detail hereinafter.

The filled bottles are placed under suitable underpressure in the station 9 and then fitted with stoppers. Similar to the two earlier described stations, the station 9 incorporates a pneumatic piston-cylinder device 49 having a piston, a piston rod 50 and a pressure plate 51, such that the cylindrical holding sleeve with bottle is pressed into sealing abutment with the plate 2. The stoppers are taken from a sterilizing apparatus and passed to a magazine 27 where they are stored and optionally sterilized and orientated, and from where the stoppers are conducted through a delivery line 20 to a guide path 23 which extends to the stoppering arrangement 24 itself. The stoppering arrangement includes a rotor 52 which, in the case of the illustrated embodiment, has two diametrically opposed cut-outs or apertures 53 and 54 which are mutually displaced parallel to one another. Each of these apertures has arranged therein a device for gripping and holding a stopper. The Figure illustrates how the device located in the aperture 54 is moved down and pushes a stopper into a bottle. Subsequent to retracting the gripping and holding device in the aperture 54, the rotor is rotated in the direction of the arrow, so that the aperture 53 will be located correctly for the gripping and holding device to grip a stopper from the path 23. Subsequent to further rotation of the rotor 52 in the direction of the arrow, the gripping and holding device will be located above a further, filled bottle and can insert the stopper into the bottle. In the case of the illustrated embodiment, the stoppering arrangement is duplicated and consequently two bottles will be stoppered in parallel at the same time. A detailed description of the construction and operation of the stoppering arrangement will be given hereinafter.

Subsequent to stoppering the bottles at the station 9, the bottles are returned to the station 6, where they are removed from their respective holding sleeves, whereafter new, empty bottles are placed in the sleeves and the process is repeated as desired.

Figure 5:
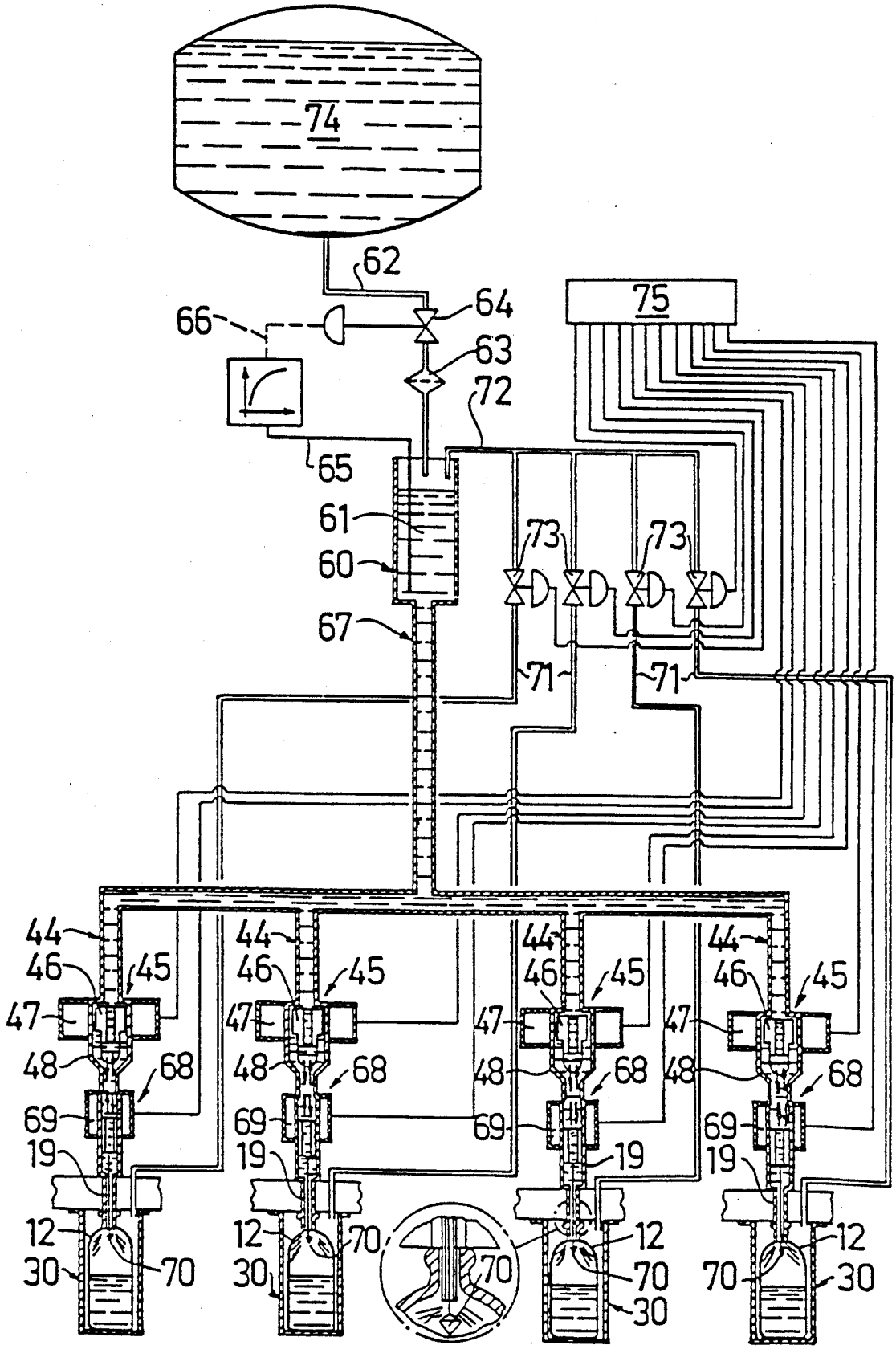
FIG. 5 is an illustration of the bottle filling arrangement.

FIG. 5 illustrates schematically the principle applied when filling the bottles in an apparatus constructed in accordance with the present invention. The Figure illustrates schematically the four bottles 12 located in their respective closed holding sleeves 30 with associated liquid delivery lines 19 and respective valves 45. A storage tank 60 contains the liquid preparation 61 with which the bottles are to be filled. A sterile liquid is passed to the storage tank from a larger storage tank 74, through a pipe 62, a sterile filter 63 and a control valve 64. The liquid level in the storage tank 61 is sensed with a sensor 65, which steers the control valve 64 in a manner to maintain the level of liquid in the tank constant, as indicated by the broken line 66.

When filling liquid into the bottles, the liquid is caused to flow from the storage tank 60 through a main pipe 67 and branch pipes 44 down into the bottles 12.

Each branch pipe or conduit incorporates two valves, the previously mentioned valve 45, which is located upstream, and further value 68 which is located downstream. The two valves are open when liquid is poured into the bottles and are closed when pouring is interrupted. The upstream valve 45 is closed first and shortly thereafter the downstream valve 68. This eliminates liquid from subsequently flowing or dripping from the downstream valve. The pouring of the liquid is best effected through the hydrostatic pressure exerted from the storage tank 60, which is located at a higher level than the bottles.

The downstream valve 68 will conveniently include a valve plug 70 which is configured so that the liquid is caused to flow into the bottle along the walls thereof, as illustrated by the small, enlarged section of the figure. This avoids to the best possible extent the occurrence of splatches when liquid is poured into the respective bottles.

As indicated in the aforegoing, the upstream valves 45 are mushroom-type valves and will therefore be well seated when subjected to high liquid pressure, since a high pressure will cause the mushroom-shaped plug 46 of the valve to be pressed more powerfully against its valve seating. The downstream valves 68 are provided with a soleniod 69 which when closing the valve draws an armature upwards and therewith also the valve plug 70 so that the plug will seal against the end of the liquid delivery line 19. This valve affords a good security against subsequent running or dripping of liquid from the valve, but because the valve is closed against the direction of the liquid pressure, the valve is unable to withstand large liquid pressures. However, because the valves 45 are located before the downstream valves and are capable of withstanding the high liquid pressure, a good seal is ensured while preventing the occurrence of subsequent running of the liquid at the same time. Because the two valves are operated by means of solenoids, the valve action is also completely contactless.

The bottle filling system also includes pressure equalizing lines 71 which extend between the space above the liquid in the storage tank 60 and the space in the cylindrical holding sleeves 30. The pressure equalizing lines 71 are collected in a main line 72 which connects with the free space above the liquid in the storage tank 60, via a control valve 73. This enables the pressure difference occurring between the storage tank 60 and the holding cylinders 30 to be equalized as filling of the bottles proceeds, so that the filling operation can be effected without disturbance. The control valve 73 is operative in enabling equalization of the pressure to be controlled so that filling of each bottle can be gently retarded towards the end of a bottle filling process, by delaying equalization of the pressure when the control valve 73 is more or less closed.

Operation of the valve 45, 68 and 73 is controlled by a programmed mechanism 75, which is connected to all valves by means of respective lines.

Figure 6:
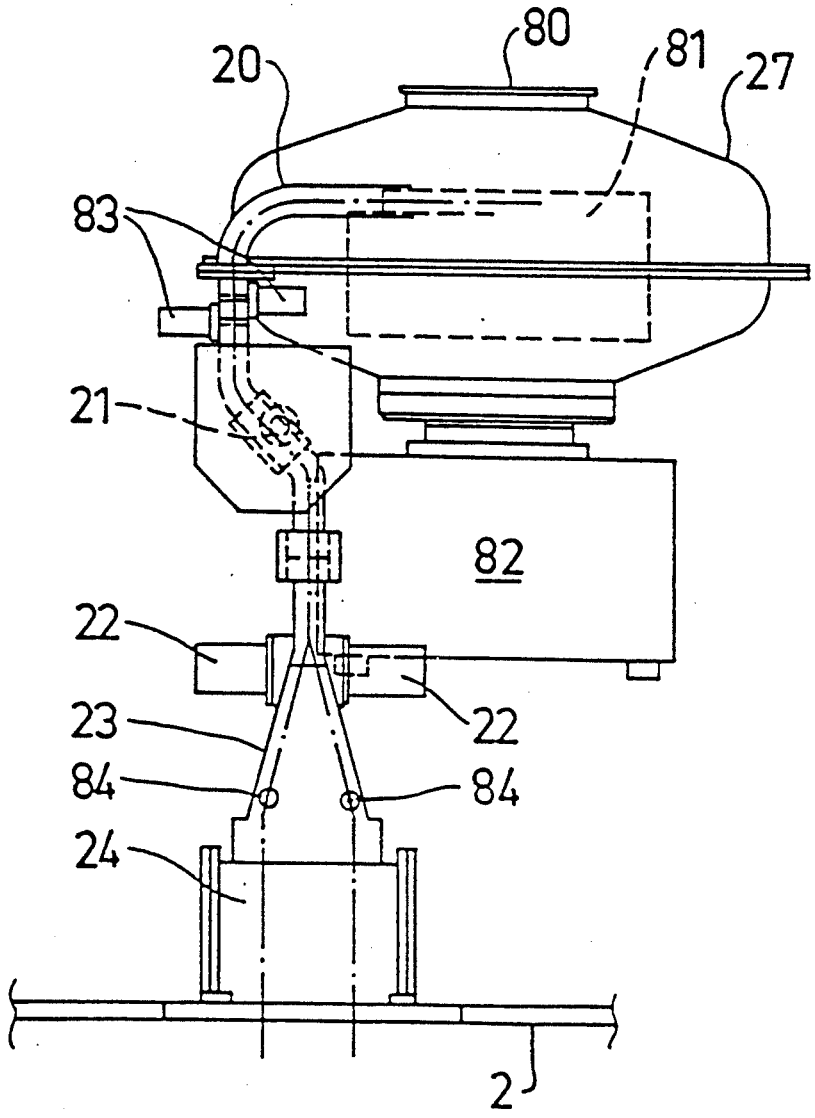
FIG. 6 illustrates schematically an arrangement for advancing and orientating stoppers for stoppering the bottles.
Figure 7:
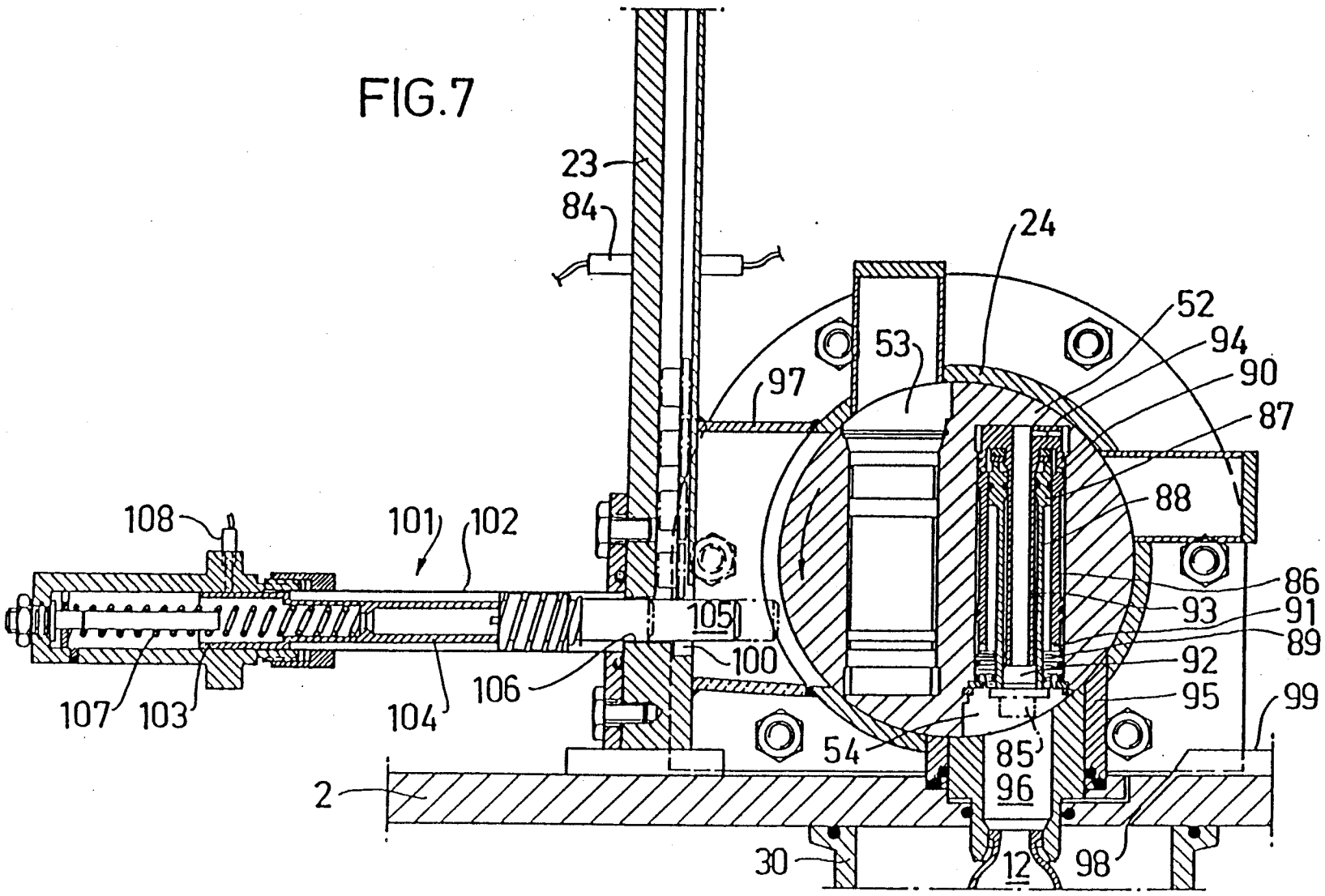
FIG. 7 illustrates the stoppering arrangement in more detail, and also shows the operation of the arrangement.

FIGS. 6 and 7 illustrate in more detail the construction and operation of the device for inserting stoppers into the filled bottles. FIG. 6 illustrates primarily an embodiment of the device for checking and handling the stoppers.

The stoppers are passed to the magazine 27 from a sterilizing apparatus (not shown) through a suitably sealed connection to the opening 80. The stoppers are fed into a known vibratory feeder 81 in the magazine 27, the feeder being driven by a motor 82. The vibratory feeder 81 orientates the stoppers so that all stoppers are turned to face in the same direction and are fed from the magazine through the line 20. In another embodiment, sterilization of the stoppers is effected in the magazine and in this case stoppers are already positioned in their correct orientation when fed into the magazine. This alternative embodiment can afford certain advantages, since sterilized stoppers are more prone to damage from external mechanical influences and an orientation process can result in deformation of the stoppers.

The control means 83 is operative in advancing the stoppers to the checking device 21 one at a time, those stoppers which are deformed or incorrectly dimensioned being rejected in the checking device 21. The checking device may have the form of a roller path which is provided with converging walls and along which the stoppers are caused to roll. Stoppers which are too large or deformed will get stuck in the roller path at an early stage and can be detected by a photoelectric sensor and removed by an ejector device. Other checking and sorting devices are possible of course.

The accepted stoppers then pass through a distributing device 22, which feeds the stoppers onto two or more paths in the guide path 23, from which the stoppers are advanced to two more mutually parallel stoppering units in the stoppering arrangement 24. A photoelectric detector 84 senses whether or not a sufficient number of orientated stoppers await insertion into the stoppering arrangement. If there are insufficient stoppers, the detector will send a signal to a control unit which, in response thereto, stops the apparatus. The stoppering arrangement is sealingly mounted on the mounting plate 2.

FIG. 7 is a sectional view which illustrates in more detail the manner in which the stoppering arrangement 24 is mounted on the mounting plate 2 and connected to the stopper guide path 23. A cylindrical holding sleeve 30 holding a filled bottle 12 is also shown tightly pressed against the undersurface of the mounting plate 2 in a position such as to enable a stopper 85 to be moved down and inserted into the neck of the bottle.

The stoppering arrangement 24 includes a rotor 52 which, in the illustrated embodiment, has two diametrically opposed apertures 53 and 54 which are mutually displaced parallel to one another and extend substantially at right angles to the axis of the rotor. These apertures are normally cylindrical in shape and each has disposed therein a respective stopper gripping and holding device. For the sake of clarity, only one of these devices is shown, in the aperture 54. It will be understood that a similar device is also disposed in the aperture 53.

Each gripping and holding device includes a piston-cylinder device 86 comprising a piston 87 and an associated piston rod 88. The forward end of the cylinder of the device incorporates a construction 89 so dimensioned that the piston rod 88 is sealingly guided there through. Gas pressure can be applied through the opening 90 behind the piston 86, so as to urge the piston forwardly, while gas pressure can also be applied in front of the piston 86, through the opening 91, so as to enable the piston to be urged rearwardly, this being possible because the piston rod 88 seals against the defining surfaces of the construction 89 in the cylinder 86. Because gas pressure can be applied, both behind and in front of the piston, the piston can be moved forwards or backwards as desired.

The piston rod 88 is hollow and is open at its forward end, and mounted in a cylindrical hole 92 in the piston is a fixed pipe or tube 93 which functions as an internal guide for the piston 86 and which communicates with a source of vacuum through an opening 94. Thus, the cavity 92 in the piston rod 88 can be placed under a subpressure or partial vacuum independently of the forward and backward movement of the piston 96 and when, as illustrated in the Figure, a stopper 85 is placed against the open end of the piston rod the stopper will be held firmly by the partial vacuum prevailing within the piston rod. The stopper can be loosened at any desired moment, by removing the partial vacuum.

Figure 3:
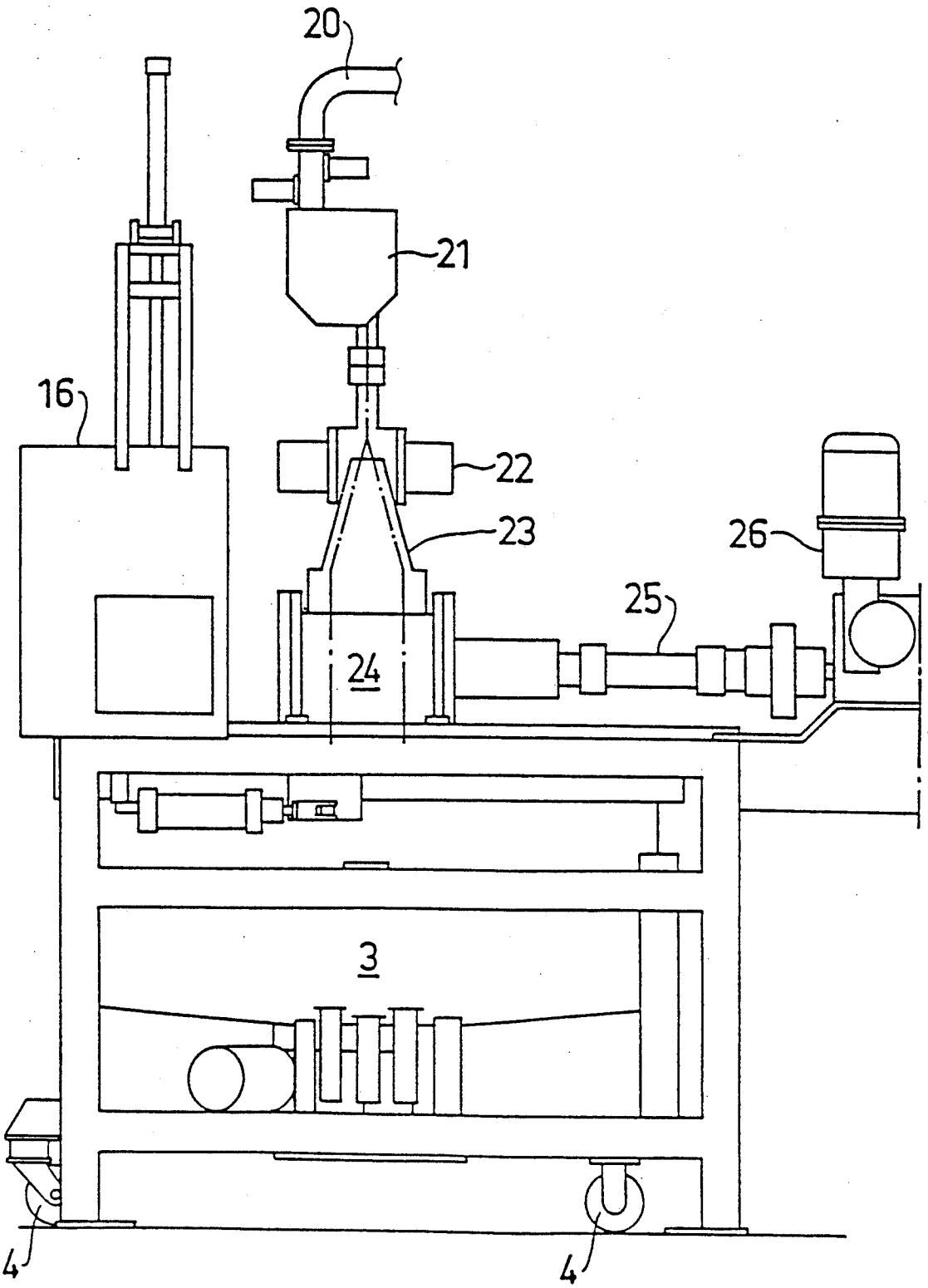
FIG. 3 is a schematic side view of the apparatus.

The rotor 52 is rotatably mounted in the housing 24 and is driven in the manner illustrated in FIG. 3. The connections for the supply of pressurized gas and for establishing vacuum conditions in respect of the bottle gripping and holding devices are passed through a hollow drive shaft in a manner known to those skilled in this art. The rotor housing 24 is also connected sealingly to the undersurface of the mounting plate 2 and to the necks of respective bottles 12, by means of a connecting piece 95 and an opening 96, and to the stopper guide path 23 by means of a connecting piece 97. Included in the guide path 23 is an opening 100 through which the stoppers can be taken for stoppering of the respective bottles.

The guide path 23 also incorporates an ejector device 101, which includes a cylinder 102 and a piston 103 which is arranged for linear movement in the cylinder. The piston 103 has a piston rod 104 which is terminated by an ejector 105. The ejector 105 passes through an opening 106 in the rear wall of the guide path 23, opening 106 is in register with the opening 100 in the front wall of the guide path. The ejector 105 can therefore be passed through the opening 100 in the front wall of the guide path forwardly of the rotor 52. The piston 103 is urged in a forward direction by the spring 107, such that in its rest position the ejector extends through the openings 105 and 100 to the close proximity of the rotor 52. The piston rod 104 together with the ejector 105 can be moved rearwardly against the pressure of the spring 107 by means of a solenoid (not shown) which surrounds the cylinder 102, such that the ejector 105 is moved rearwardly through the opening 100 and 106 in the guide path 23. The position of the piston 103 is detected by the sensor 108, thereby enabling the solenoid operation to be controlled as a function of the movement of the stoppering piston 87.

Because the ejector 105 is located forwardly in its rest position and need only be moved rearwardly when a stopper is to be collected from the guide path 23, stoppers which wait in the guide path to be moved forwardly are prevented from falling down prematurely and becoming obliquely positioned so as to disturb the operation of the apparatus.

The mounting plate 2 also conveniently incorporates an opening 98 which connects the enterior of the hollow cylinder 30 with a vacuum source through the conduit 99. This enables an underpressure to be established in the hollow cylinder 30 with the bottle 12 prior to stoppering the bottle.

The stoppering arrangement operates in the following manner:

In the operating state illustrated in FIG. 7, the arrangement is ready for the insertion of a stopper into a bottle. This can be effected by applying gas pressure through the opening 90, so that the piston 87 is moved downwards. An underpressure prevails in the hollow piston rod 88, such that the stopper 85 will be held by suction against the open end of the piston rod. Located beneath the stoppering arrangement is a bottle holding sleeve 30 by means of which bottle 12 is held in register with the direction of movement of the piston rod 88, and an underpressure has also been generated within the sleeves 30 through the opening 98 and the vacuum conduit 99. Thus, it is not always necessary to apply an underpressure through the opening 90 rearwardly of the piston 87, since the underpressure in the holding sleeve 30 and the bottle 12 may be sufficient to draw out the piston 87, the piston rod 88 and the stopper 85. The value of the underpressure set in the holding sleeve and bottle is determined in part by the temperature of the liquid with which the bottle is filled. When the liquid is cold, this underpressure can be set to a lower value than when the liquid has a higher temperature, since when the pressure is excessively low there is a risk that warm liquid will begin to boil.

The piston rod 88 and the stopper 85 firmly held thereto are also moved downwards with the piston 87, so as to insert the stopper into the mouth of the bottle 12. Since an underpressure also prevails in the space in the hollow sleeve 30, no appreciable counterpressure will be exerted in the bottle as the stopper is inserted thereinto. Subsequent to inserting the stopper into the bottle 12, the stopper is released from the end of the hollow piston rod 88, for example, by terminating the underpressure through the opening 94, whereafter the piston 87 with the piston rod 88 is moved back by applying gas pressure through the opening 91 while at the same time relieving any possible gas pressure through the opening 90.

When the piston 87 has returned to its inward position, the rotor 52 is turned through one quarter of a revolution in the arrowed direction, so that the two apertures 53 and 54 will now be directed horizontally. The apertures 53 will now be directed towards the stopper guide path 23 and the ejector 105. As beforementioned, a gripping and holding device similar to that arranged in the aperture 54 is also arranged in the aperture 53, and the following description of the device located in the aperture 53 is made with the use of the same reference signs as those used for the description of the device located in the aperture 54.

Stoppers are fed down into the stoppering arrangement along the guide path 23 and past the detector 84, with the longitudinal axes of respective stoppers extending horizontally and the top surfaces of the stoppers facing towards the stoppering arrangement. The stoppers can be fed to the gripping and holding device through the opening 100 in the guide path 23, but are prevented from falling down to the outfeed position when the ejector 105 is located in its forward position. When the gripping and holding device is in its horizontal position, gas pressure is applied through the opening 90 so that the piston 87 with the hollow rod piston 88 will be moved away from the rotor 52, towards the opening 100 in the guide path. At the same time, the piston rod 104 is activated by means of the solenoid around the cylinder 102, such that the ejector 105 is withdrawn through the opening 100 and 106 in the guide path. Located between the end of the hollow piston rod 88 and the end of the ejector 105 is a space which is adapted to correspond to the height extension of a stopper 85. When the piston rod 88 and the ejector 105 have moved through a distance such that the space therebetween is located opposite the transport space in the guide path 23, a stopper will fall down into said space and since this space is adapted to the height extension of the stopper the risk of a stopper being positioned obliquely so as not to be correctly gripped by the gripping or holding device is eliminated.

The stopper is held firmly by suction against the open end of the piston rod 88, as a result of applying an underpressure through the opening 94. Gas pressure is then applied through the opening 91 and the pressure through the opening 90 relieved, so that the piston 87, the piston rod 88 and the stopper 85 held thereon are drawn into the aperture 53 in the rotor 52.

At the same time, current to the solenoid around the ejector cylinder 102 is interrupted, so that the ejector 105 will be moved out through the openings 106 and 100 in the guide path 23, under the action of the spring 107, thereby assisting in guiding the movement of the stopper to the rotor. The ejector 105 will, at the same time, prevent the following stoppers in the guide path 22 from falling down and possibly being incorrectly positioned such as to disturb the operation of the apparatus.

Subsequent to the rotor 52 turning through a further quarter of a revolution in the arrowed direction, the gripping and holding device with the stopper 85 held thereby is in position for inserting the stopper in a further bottle.

The ejector 105 remains in its extended position until the rotor has been rotated through a further quarter of a revolution and a further stopper shall be collected from the guide path.

During the time taken for the gripping and holding device to collect a further stopper from the guide path 23, the underpressure within the hollow sleeve 30 has been removed through the opening 98, and the smaller carrousel, which carries the cylindrical holding sleeves, has been turned through half a revolution, so that a further bottle is positioned for stoppering. The holding sleeve 30 is now pressed upwards into sealing abutment with the mounting plate 2, by means of the piston-cylinder device 47 (FIG. 4), whereafter an underpressure is again established through the opening 98. This further bottle 12 is now ready to be stoppered in the same manner as that described above.

As mentioned in the aforegoing, the illustrated embodiment of the stoppering units in the rotor 52 is duplicated so as to enable two bottles to be stoppered in parallel and so that two stoppers can be collected simultaneously from two mutually parallel guide paths 23. Consequently, all bottles located in the smaller carrousel in station 9 will be stoppered in the cyclic stoppering sequence, It has been found advantageous to provide the rotor 52 with an outer cylindrical surface which forms part of a sphere, such that the rotor will form a spherical zone. This facilitates journalling of the rotor in the housing 24 and will afford better sealing in the event of wear. The connecting piece 95 is also sealingly adapted to the rotor around the aperture 54. Consequently, the underpressure applied in the sleeve 30 will be isolated to restricted parts of the apparatus.

The stoppering arrangement used in accordance with the invention affords certain important advantages which are not found with devices previously used for the same purpose. Thus, the bottles are stoppered in a completely closed system which can be readily closed-off from the contaminating surroundings, while the machine elements used are of simple construction and have known functions. Furthermore, the device provides the important advantage of enabling moist stoppers to be used directly from a steam sterilizing facility, thereby obviating the need to siliconize the stoppers to the same extent as that previously required. Hitherto it has been considered an absolute necessity to treat the stoppers with silicone, in order to facilitate insertion of the stoppers into the bottles. The silicone treatment of stoppers, however, is not completely unobjectionable, since there is a danger of silicone entering the preparation with which the bottles are to be filled.

The operation of the complete apparatus according to the invention will now be described with reference to FIG. 1.

The sterile bottles 12 are passed to the apparatus from a sterilizing device through a tunnel 17 which is connected sealingly to the tunnel 14 through the connecting piece 15. The bottles are held by a comb-like gripper 13, which ensures that the bottles will have the correct interspacing. The gripper 13 is movable in its longitudinal and transverse directions and transports the bottles stepwise into the tunnel 14, each step corresponding to two bottle positions. The gripper 13 is then withdrawn out of contact with the bottles, whereafter the gripper is moved rearwardly in its longitudinal direction and then transversely or laterally forwards to its starting position, in which it receives a further two bottles from the tunnel 17.

The bottles 12 are advanced until two empty bottles are located above respective ones of two holding sleeves 31 in the station 6 of the larger carrousel 5, while simultaneously herewith two filled and stoppered bottles 11 are moved out of this station. In station 6, the carrier plate 35 in the sleeve 30 (FIG. 4) occupies its uppermost position and supports the bottle, which are lowered down into the sleeve by retracting the piston in the cylinder 31. The bottle is, at the same time, flushed internally with an inert gas, so as to displace the atmospheric oxygen entrained in the bottle, as illustrated in FIG. 4.

Subsequent to two bottles having been lowered into their respective holding sleeves in the station 6, the smaller carrousel in this station is rotated through half a revolution, so that the two remaining bottle holding sleeves in the station will be positioned correctly beneath the gripper 13, said gripper, at the same time, having been moved rearwardly and in its longitudinal direction, back to its starting position. The piston in the cylinder 31 is then moved upwardly in the cylinder, such that the carrier plate 34 will lift the filled bottles to a position in which they can be seized by the gripper 13. The gripper is then again stepped forward through one step in the longitudinal direction, such as to remove the two filled and stoppered bottles and to move two further empty bottles to a position in which they can be inserted into the bottle holding sleeves in the station 6, in the same manner as that described above. Subsequent to filling the four sleeves 30 in the station 6 with respective empty bottles, the larger carrousel is turned through one quarter of a revolution in the arrowed direction, so as to bring the bottles to the station 7.

In the station 7 the holding sleeves 30 are brought into gas-tight abutment with the undersurface of the mounting plate 2, by urging the sleeves upwardly by means of the piston-cylinder devices 38 (FIG. 4). The holding sleeve 30 with the bottles located therein are then alternately placed under a partial vacuum and flushed with an inert gas through the connection conduits 18, in this step normally with gaseous nitrogen, so as to remove all traces of oxygen present in the bottles. When flushed of the bottles has been completed, the connection between the holding sleeves and mounting plate 2 is removed, by relieving the pressure in the piston-cylinder devices 38 and the larger carrousel is further rotated one quarter of a revolution in the arrowed direction, so as to bring the bottles into the station 8 for filling.

In the station 8, the bottle holding sleeves 30 are again pressed upwards in the same manner as that in the station 7, so as to be brought into sealing abutment with the mounting plate 2. The bottles are then filled with the liquid preparation through the bottle filling lines 19, as described in detail with reference to FIG. 5. The provision of two closing valves 45 and 70 prevents the occurrence of subsequent running or dripping of the liquid preparation, which would otherwise contaminate the mouths and outer surfaces of the bottles. When the bottles have been filled, the pressure in the piston-cylinder devices 41 is again relieved, so as to release the sealing abutment between the holding sleeves 30 and the mounting plate 2, whereafter the larger carrousel is rotated through a further quarter of a revolution in the arrowed direction, so as to bring the bottles into the stoppering station 9.

In the station 9, two of the bottle holding sleeves 30 are again brought into gas-tight abutment with the undersurface of the mounting plate, whereafter an underpressure is established in the interior of the holding sleeves and bottles through the opening 98 (FIG. 7). The two bottles are then stoppered in the manner described in detail with reference to FIG. 7. Subsequent to stoppering the bottles, the underpressure in the sleeves is removed and the sleeves are lowered by means of the piston-cylinder devices 49, whereafter the smaller carrousel in this station is rotated through one half revolution, so as to bring the two remaining bottles into the stoppering position, where the bottle holding sleeves are brought into sealing abutment with the mounting plate and subjected to underpressure. At the same time, the rotor 52 of the stoppering unit (FIG. 7) has first rotated through one quarter of a revolution and the gripping and holding devices have collected two further stoppers from the guide paths 23, after which the rotor has been rotated through a further quarter revolution, so as to bring the stoppers to a position for insertion into the bottles. The two remaining bottles are then stoppered.

Subsequent to all four bottles having been stoppered in the station 9, the holding sleeves 30 are moved out of contact with the mounting plate 2 and the larger carrousel is rotated through a further quarter revolution, so as to bring the filled and stoppred bottles to the starting position in the station 6. Two of the bottles are now moved out of their respective sleeves 30 by means of the piston-cylinder devices 31 and the carrier plates 35, so that the bottles can be siezed by the comb-like gripper 13 and moved out through the tunnel 14 for wrapping or encapsulation of the stoppers, while at the same time two empty bottles are brought into position for lowering into the bottle holding sleeves. The smaller carrousel in this station is then rotated through half a revolution, so that the two remaining filled and stoppered bottles are brought to a position for removal from their respective sleeves 30 and removal through the tunnel 14. This completes one bottle filling and stoppering cycle, and the cyclic procedure can be repeated for as long as desired.

The described and illustrated arrangement for transporting bottles between the various treatment stations and comprising a large carrousel which includes a multiple of smaller carrousels affords a number of important advantages. One advantage is that movements are more gentle than rectilinear movement, so as to reduce the risk of splashes. It is also easier to control these movements and the space required by the system as a whole is smaller than that required by a linear system. The indexing movement of the carrousel can be achieved in several different ways, all known to one skilled in this art, for example with the aid of a maltese-cross mechanism or stepping motors.

Because each of the intended positions of the larger carrousel is comprised of a smaller carrousel, further advantages are gained. For example, in the case of the illustrated embodiment, the time taken to carry out the important steps of evacuating and rinsing the bottles and also filling of the bottles can be made twice as long as the time taken to stopper the bottles and to insert and remove the bottles, since in the first-mentioned steps all four bottles are treated at the same time, while in the two remaining steps the bottles are treated two at a time by rotating the smaller carrousel between the insertions and removals. Because there is more time at disposal for evacuating and flushing the bottles with inert gas, the bottles can be flushed more thoroughly, while, due to the longer period for filling of the bottles, the bottles can be filled with liquid gravitationally, thereby obviating the need to fill under pressure and avoiding the associated disadvantages of foaming and spillage.

As beforementioned, the entire bottle transporting arrangement and associated apparatus are housed in a pressure-tight container 3 which is sealingly connected to mounting plate 2. The shaft driving the larger carrousel and the connections for inert gas, vacuum etc., are connected by means of gas-tight or impervious bushings. These bushings are made detachable, so as to enable the container 3 to be removed readily for maintenance purposes. Connections for steam and washing liquid for sterilizing purposes are also arranged in a similar manner, so that the apparatus, under normal circumstances, can be cleansed and sterilized without needing to be dismantled. Furthermore, the delivery of sterile empty bottles and sterile stoppers, and also the removal of filled and stoppered bottles, takes place through suitable sterile locks of a known kind, so as to eliminate the risk of contamination. For instance, the sealing lock arrangement through which the filled bottles are removed may be in the form of a single or double liquid locks or traps. In order to further prevent contamination, the whole of the interior of the apparatus is preferably placed under a slight overpressure of a sterile, inert gas, such as gaseous nitrogen. This will provide a fully sterile, closed system without the risk of backflow of a contaminated air.

The liquid and steam connections enable the apparatus to be cleansed and then sterilized with steam at conventional temperatures of about 120° C. without need to dismantle the apparatus. When sterilization has been completed, the steam is replaced with an inert gas, for example nitrogen, and the apparatus is maintained at overpressure as the apparatus cools down. This eliminates any form of contamination by oxygen and/or microorganisms.

The various apparatus and devices in the different treatment stages are operated electrically and pneumatically. The working medium used in the pneumatic devices is a sterile, inert gas, such as gaseous nitrogen. The construction of the various machine components and elements incorporated in the system are all known in themselves and can be readily identified by one skilled in this art who has an understanding of the intended function.

The manner of operation of the individual devices and apparatus from which the machine as a whole is composed is preferably controlled by a master computer. The computer is designed to receive control pulses from position sensors, temperature sensors, pressure sensors and valve-state sensors of a kindknown. The position sensors may advantageously be fibre optic sensors.

The inventive apparatus is primarily intended to operate at a temperature from 5° to 85° C. when filling bottles. This temperature range lies beneath the sterilizing temperatures (about 120° C.) and is made possible by the stringent aseptic working method applied. This enables, to great advantage, sensitive substances to be filled without risk of decomposition of the substances or any other undesired change therein. Examples of such sensitive substances include amino acid solutions, particularly in combination with carbohydrates for nutrient purposes. Emulsion-type preparations can also be sensitive, since the emulsion will break down at excessively high temperatures. The present invention also enables additives to be made to these solutions or the separate filling of other heat-sensitive solutions such as vitamins, hormones, antibiotics, cytostatics, etc.

A number of comparison tests have been carried out under different conditions in order to establish the stability of solutions of amino acids and carbohydrates filled into bottles in a conventional manner and filled into bottles aseptically with the aid of an apparatus constructed in accordance with the present invention. These tests are described in the following examples and the results are set forth in FIGS. 8, 9 and 10.

EXAMPLE 1

A solution of amino acids and carbohydrates having the composition (expressed in g/l):

| | |
|---|---|
| L-alanine | 2.10 |
| L-arginine | 2.31 |
| L-aspartic acid | 2.84 |
| L-cysteine hydrochloride | 1.44 |
| L-phenylalanine | 3.82 |
| L-glutamic acid | 6.30 |
| L-histidine | 1.68 |
| L-isoleucine | 2.73 |
| L-leucine | 3.68 |
| L-lysine hydrochloride | 3.36 |
| L-methionine | 1.33 |
| L-proline | 5.67 |
| L-serine | 5.25 |
| L-threonine | 2.10 |
| L-tryptophane | 0.71 |
| L-tyrosine | 0.35 |
| L-valine | 2.98 |
| Glycine | 1.47 |
| Sodium chloride | 0.24 |
| Potassium chloride | 1.01 |
| Calcium chloride $2H_2O$ | 0.58 |
| Magnesium lactate $2H_2O$ | 0.95 |
| Dipotassium hydrogen phosphate | 1.16 |
| Sodium hydroxide, tablets | 1.70 |
| Glucose monohydrate | 183.3 |
| Distilled water to | 1000 ml |

was prepared from sterile components and poured into standard infusion bottles with the aid of a conventional method, whereafter the filled bottles were sterilized in an autoclave. The bottles were then divided into three groups and the first group was stored in light at room temperature, the second group was stored in darkness at room temperature and the third group was stored in a refrigerator at 2°-8° C.

Samples of the same solution were then poured into similar bottles aseptically at a low temperature with the aid of an apparatus constructed in accordance with the invention. One group of the filled bottles was stored in darkness at room temperature and one group in a refrigerator.

Figure 8:
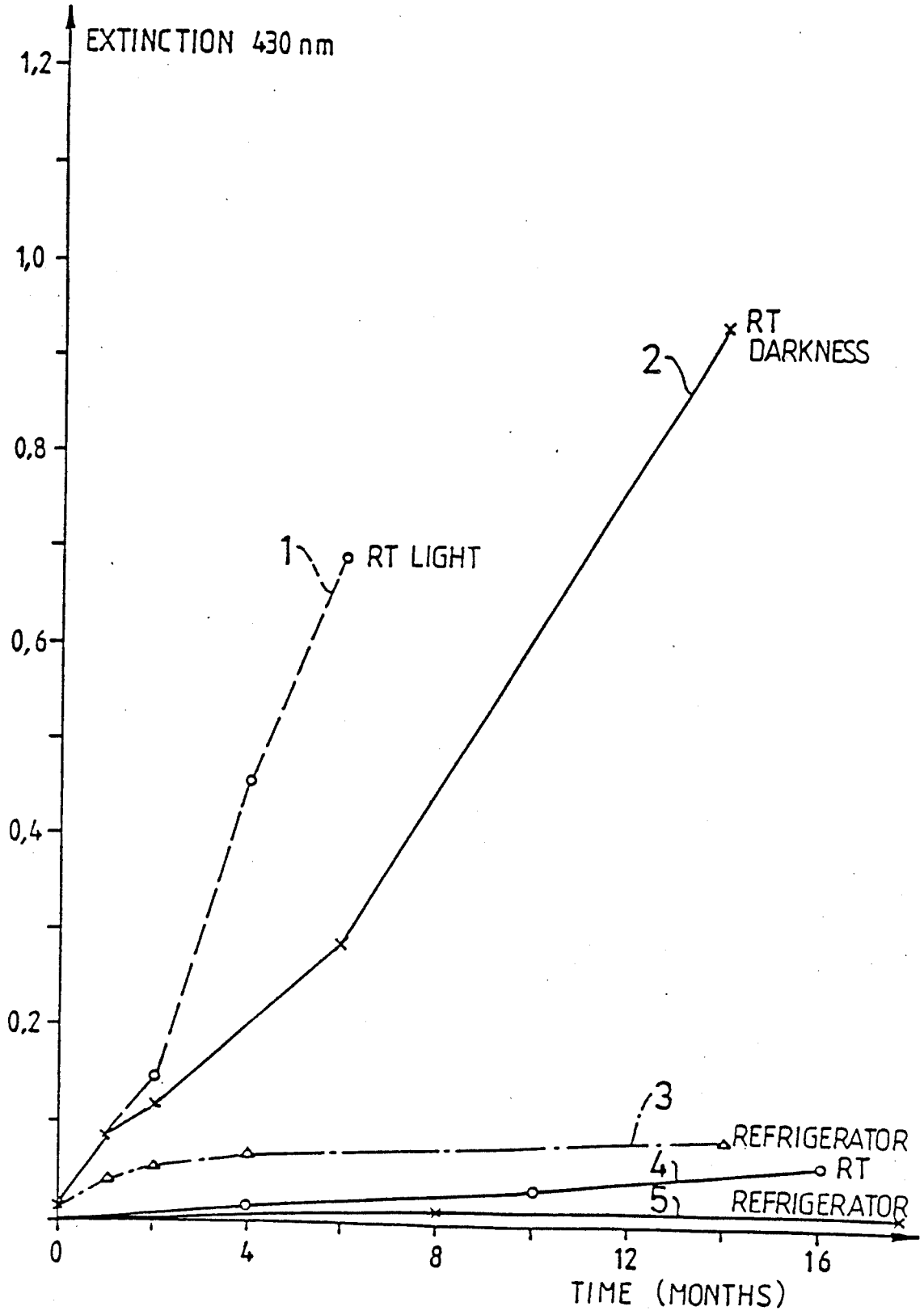
FIGS. 8 and 9 are diagrams which show the results obtained when comparing the durability of preparations filled in a conventional manner with the durability of preparations filled by means of the inventive apparatus.

The stability of the respective solutions was determined by measuring their light extinction at 430 nm, this extinction becoming stronger the greater the undesired changes undergone by the solution. The results are illustrated in the graphs of FIG. 8.

It will be clearly seen from these graphs that when stored in light and at room temperature (graph 1) the sample bottled in a conventional manner exhibited a poor stability and a rapidly increasing extinction. A somewhat better result was obtained with the sample stored in darkness at room temperature (graph 2) although the stability afforded by the method is still unsatisfactory. A substantially improved stability was obtained with the sample which was stored in a refrigerator (graph 3).

Those samples which were bottled by the present invention apparatus gave better results when stored at room temperature (graph 4) than the results obtained with the conventional samples stored in a refrigerator. A further improvement was obtained with the sample bottled in accordance with the invention and stored in a refrigerator (graph 5). Thus, preparations which are filled aseptically with the aid of the inventive apparatus are much less liable to be harmed when subjected to moderate heat. However, the differences in stability in this respect can vary between different types of preparations.

EXAMPLE 2

This test was carried out in a manner similar to Example 1 but with a preparation having the following composition, expressed in g/1:

| | |
|---|---|
| L-alanine | 5.88 |
| L-arganine | 4.12 |
| L-aspartic acid | 1.23 |
| L-cysteine | 0.21 |
| L-phenylalanine | 2.89 |
| L-glutamic acid | 2.06 |
| l-histidine | 2.50 |
| l-isoleucine | 2.06 |
| l-leucine | 2.89 |
| L-lysine hydrochloride | 4.16 |
| L-methionine | 2.06 |
| L-proline | 2.50 |
| L-serine | 1.67 |
| L-threonine | 2.06 |
| L-tryptophane | 0.69 |
| L-tyrosine | 0.08 |
| L-valine | 2.70 |
| Glycine | 2.89 |
| Sodium chloride | 2.72 |
| Potassium chloride | 1.00 |
| Calcium chloride $2H_2O$ | 0.59 |
| Magnesium sulphate $2H_2O$ | 0.99 |
| Dipotassium hydrogen phosphate | 1.16 |
| Glucose monohydrate | 220.0 |
| Distilled water to | 1000 ml |

From this preparation one group of bottles was filled in a conventional manner and stored in a refrigerator, whereas two groups of bottles were filled by means of an apparatus constructed in accordance with the present invention and stored at room temperature and in a refrigerator respectively.

Figure 9:
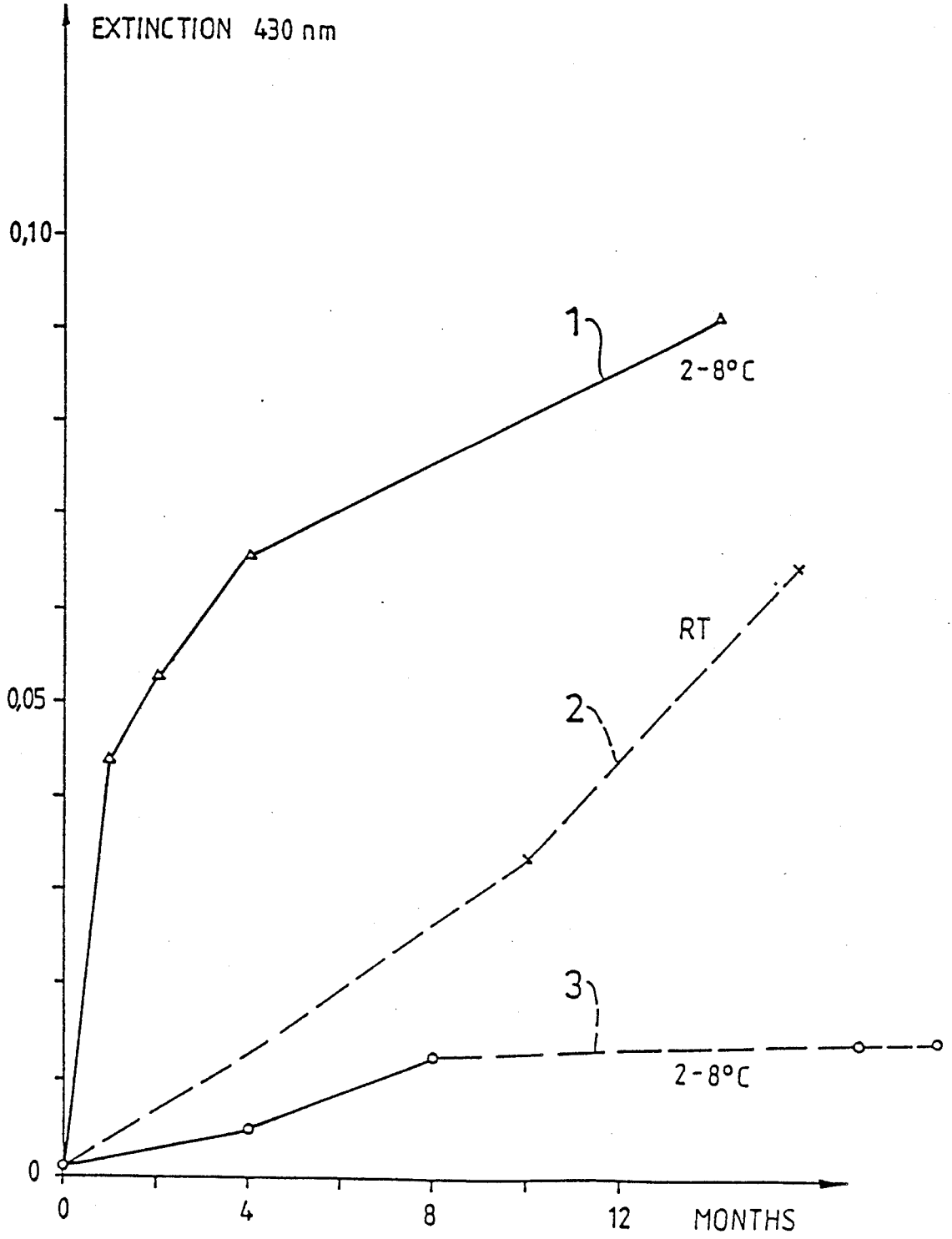
Figure 10:
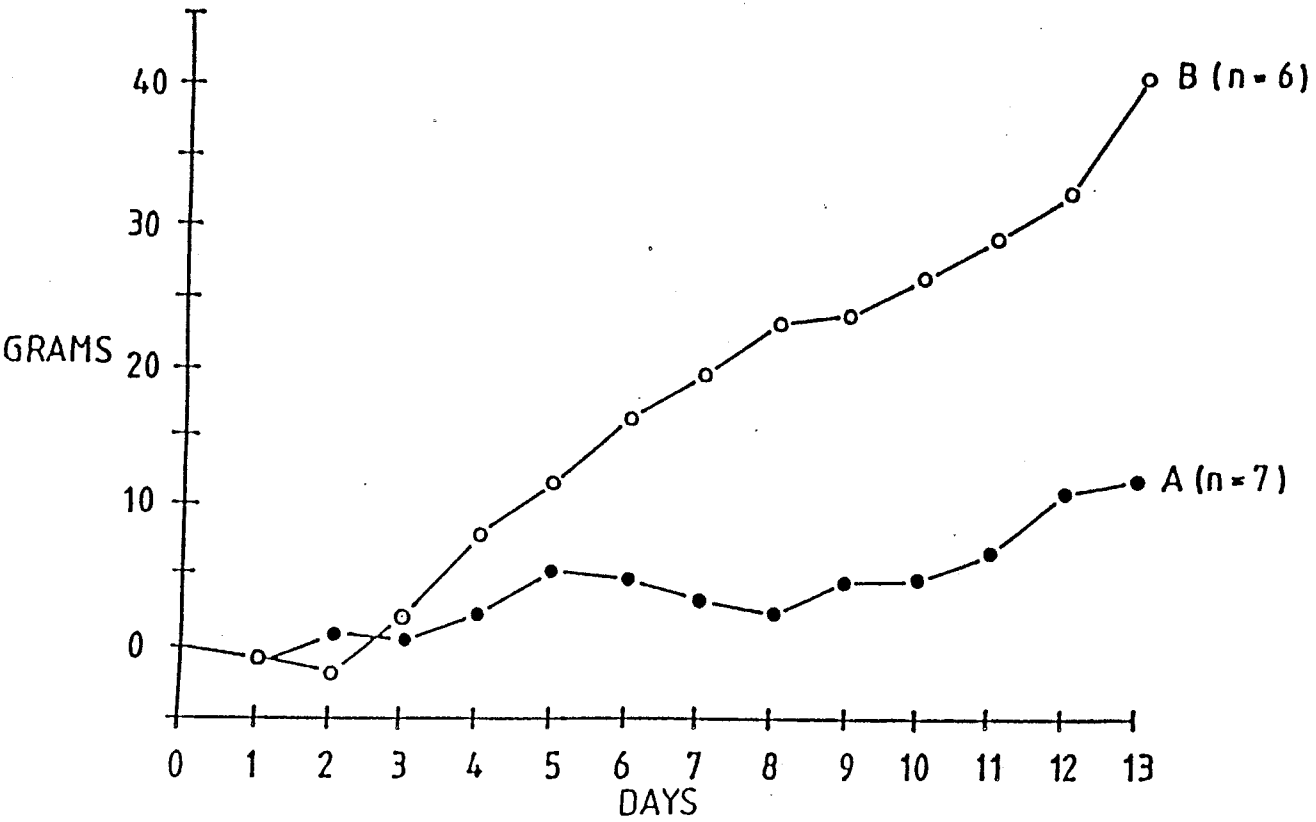
FIG. 10 is a diagram which shows the results obtained when comparing infusion tests carried out while using conventionally filled preparations and while using preparations filled in accordance with the present invention.

The stability of the preparations was determined in the same manner as that described in Example 1 and the results of these tests are set forth in the graphs of FIG. 9.

It will be seen from these graphs that the preparation bottled in accordance with the conventional technique (graph 1) had a much poorer stability even when stored in a refrigerator at 2°-8° C. than preparations which had been bottled by means of the inventive apparatus. A preparation thus bottled exhibited a superior stability even when stored at room temperature (graph 2), and this stability was further improved when storing the preparation in a refrigerator (graph 3).

EXAMPLE 3

This test comprised infusion experiments on rats with a nutrient infushion solution having the following composition:

| | |
|---|---|
| Glycine | 2.1 g |
| L-aspartic acid | 4.1 g |
| L-glutamic acid | 9.0 g |
| L-alanine | 3.0 g |
| L-arginine | 3.3 g |
| L-cysteine | 1.4 g |
| L-histidine | 2.4 g |
| L-isoleucine | 3.9 g |
| L-leucine | 5.3 g |
| L-lysine | 3.9 g |
| L-methionine | 1.9 g |
| L-phenylalanine | 5.5 g |
| L-proline | 8.1 g |
| L-serine | 7.1 g |
| L-threonine | 3.0 g |
| L-tryptophane | 1.0 g |
| L-tyrosine | 0.5 g |
| L-valine | 4.3 g |
| $CaCl_2.2H_2O$ | 368 mg |
| KCl | 375 mg |
| $MgSO_4.7H_2O$ | 370 mg |
| Glucose, water-free | 100 g |
| KOH + NaOH | q.s. to pH 5.2 |
| Water to | 1000 ml |

Two batches of the solution were prepared, of which one batch was filled into bottles in a conventional manner and the other batch was aseptically filled into bottles with the aid of the inventive apparatus.

Infusion experiments were carried out on two groups of rats with the two preparations using a quantity of infusion solution which, in each particular case, corresponded to a dosage of 2.4 g of N per kg of body weight and day. The mean increase in body weight was determined daily and the results are disclosed in the graphs of FIG. 10.

It will be seen from these graphs that a considerably greater and significant increase in weight was obtained with those rats to which the aseptically bottled preparation was administered. The reason for this would seem to be that the conventionally bottled preparation had undergone chemical changes which impaired its nutrient value. No such changes, or in any event only negligible changes, were found to have occured in the aseptically bottled preparation.

In summary, the inventive bottling apparatus affords a number of important advantages:

(1) Contamination from external sources is prevented because all of the different procedural steps are carried out in a closed system. The ingress of oxygen and other contaminants is further prevented by maintaining the interior of the apparatus at an overpressure with the aid of a sterile, inert gas.

(2) Because the bottling procedure is carried out aseptically from the very outset, the bottled preparations need not be exposed to high temperatures, but can be treated under gentle conditions. This improves the stability of sensitive preparations and enables preparations which are impaired when subjected to conventional heat treatment processes to be bottled on an industrial scale.

(3) Because, in accordance with a preferred embodiment, the bottle transporting device comprises a large carrousel comprising a multiple of smaller carrousels, there is obtained a compact machine structure which enables available space to be utilized in the best possible manner. Furthermore, the arrangement enables all movements to be effected smoothly with less risk of splashing. Finally, the smaller carrousels enable the time periods required for the various treatment steps to be varied, so that evacuation and filling of the bottles can be effected over a longer time period than the time periods required for the remaining stages.

(4) Because, in accordance with the invention, the bottles are stoppered in a closed system, it is possible to work with moist, sterilized stoppers and therefore to obviate the need of subjecting the stoppers to strong silicone treatment. This reduces the risk of the solutions becoming contaminated with silicone.

(5) Because of the particular construction of the apparatus, the apparatus can be cleansed and sterilized easily without any need to dismantle the apparatus. Should it be necessary to dismantle the apparatus, this can be readily done, although it is not necessary solely for the purpose of sterilizing or cleansing the apparatus.

The inventive apparatus has been described in the aforegoing primarily with reference to the embodiments illustrated in the accompanying drawings. It will be understood, however, that the illustrated embodiments do not limit the scope of the invention, since other modifications and variants of the invention are possible within the scope of the following claims.

For example, the number of locations for bottle holding devices in the smaller carrousels need not be precisely four, but may vary between, for instance, two and twelve, and this number will only be limited for practical reasons. As will be understood, when the number of locations provided is different to four, the constructions in the various treatment stations must be modified correspondingly, although this will not create difficulties to one skilled in this art. Neither is it necessary for the small carrousels to be rotated precisely through one half of a revolution each time, since these carrousels can be rotated a plurality of times through a suitable angle commensurate with the number of locations in the small carrousel.

Movement between the holding devices and the various treatment stations may also be linear instead of circular as in the case of the illustrated embodiment. In this case the large carrousel is omitted and movement takes place along a linear path. Return movement of the holding devices from the last treatment station in line to the first treatment station can then be achieved in various ways. The smaller carrousels can be retained, however, in order to achieve the advantages associated therewith.

The arrangements for sterilizing, handling and inserting the stoppers, may also be constructed in different ways to that illustrated and described. The only essential requisite in this respect is that these operations can be carried out in a closed system while maintaining sterile conditions.

For example, the bottle stoppering rotor need not necessarily include only two apertures displaced through 180° and accommodating gripping and holding devices. Instead, the rotor may incorporate four apertures mutually displaced through 90°, or some other number, preferably an even number, such as six, eight or twelve, these apetures suitably being placed at mutually similar angular distances around the periphery of the rotor. It is not necessary, however for these apertures to be an even number or to be located at mutually equal angular distances, since the number of apertures provided may also be an odd number and the division therebetween irregular, in which case rotation of the rotor is controlled by a programmed mechanism so that each gripping and holding device will be brought in turn to a correct position for gripping a stopper and then inserting said stopper into a bottle. Depending upon the number of locations in the small carrousels, the stoppering arrangement need not necessarily be duplicated, and the number of stoppering units may, alternatively, be adapted to the number of locations provided.

In accordance with another variant, the stoppering arrangement may be constructed such that a stopper is gripped and drawn into or pressed into the rotor aperture in a first station and then dropped down into the neck of the bottle. The stopper will then be pressed into the bottle in a following station.

We claim:

1. An apparatus for aseptically filling bottles with a liquid preparation, comprising:

a sltation in which the sterile bottles are delivered into bottle holding devices and the bottles are purged of air with an inert gas;

a station in which the bottles are subjected to a pressure below ambient pressure and flushed or rinsed with an inert gas;

a station in which the bottles are filled with the liquid preparation;

a station in which the filled bottles are sealed;

a station in which the filled and sealed bottles are removed from the bottle holding devices; and a transporting system which is operative to provide a successive, relative movement between the bottles in the holding devices and the stations and wherein said stations and said transporting system are enclosed by a pressure-tight casing such that the entire apparatus forms a closed system, said closed system being provided with sealing locks for the sterile infeed and outfeed of materials and products.

2. An apparatus according to claim 1, wherein the bottle filling station is constructed such that liquid from a storage container in which the liquid level is held constant, is conducted to the bottles gravitationally through a delivery line which incorporates two sequentially arranged valves; and wherein controllable return pressure equalizing line is arranged between the liquid storage container and the space in the cylindrical bottle holding device.

3. An apparatus according to claim 2, wherein the two valves are mushroom-type valves and are operated in a contactless manner by means of solenoids; and wherein the mushroom-shaped plug of the valve located upstream in the liquid flow direction is moved into sealing abutment with its sealing in the direction of said liquid flow, whereas the mushroom-shaped plug of the downstream valve is moved into sealing abutment with its sealing against the direction of liquid flow; and wherein the upstream valve is arranged to be closed before the downstream valve.

4. An apparatus according to claim 3, wherein the bottle sealing station includes a magazine for orienting sterile stoppers, and a guide path for advancing said sterile stoppers, and a device for gripping and holding the oriented stoppers one by one and subsequently inserting the stoppers into respective bottles.

5. An apparatus according to claim 4, wherein the guide path for advancing the stoppers incorporates a checking device in which stoppers which are deformed or incorrectly dimensioned are sorted out.

6. An apparatus according to claim 4, wherein the device for gripping, holding and inserting the stoppers has the form of a rotatable cylinder or rotor whose cylindrical surface incorporates at least one substantially cylindrical aperture whose axis extend substantially perpendicularly to the rotor axis; wherein each of the apertures has located therein a device for gripping and holding a stopper and subsequently inserting the stoppper into a respective bottle and releasing the stopper from the holding device wherein the rotor is so constructed that when one of the apertures is directed essentially towards the stopper guide path, the gripping and holding device located in said aperture will grip a stopper in the guide path and hold said stopper, whereafter the rotor is rotated so that the longitudinal axis of the aperture will be in line with the longitudinal axis of the bottle and the gripping and holding device moves the stopper towards the bottle and inserts said stopper into the neck of the bottle, whereafter the stopper is released and simultaneously, or subsequent to further rotation of the rotor, a subsequent aperture is aligned with the guide path and a gripping and holding device located in said further aperture seizes a following, oriented stopper in the guide path and holds said stopper and, subsequent to further rotation of the rotor, inserts the stopper in a subsequent bottle, this procedure being repeatable.

7. Apparatus according to claim 1, wherein the bottle sealing station includes a magazine for orienting sterile stoppers, and a guide path for advancing said sterile stoppers, and a device for gripping and holding the oriented stoppers one by one and subsequently inserting the stoppers into respective bottles.

8. An apparatus according to claim 7, wherein the guide path for advancing the stoppers incorporates a checking device in which stoppers which are deformed or incorrectly dimensioned are sorted out.

9. An apparatus according to claim 7, wherein the device for gripping, holding and inserting the stoppers has the form of a rotatable cylinder or rotor whose cylindrical surface incorporates at least one substantially cylindrical aperature whose axis extend substantially perpendicularly to the rotor axis; wherein each of the apertures has located therein a device for gripping and holding a stopper and subsequently inserting the stopper into a respective bottle and releasing the stopper from the holding device; wherein the rotor is so constructed that when one of the apertures is directed essentially towards the stopper guide path, the gripping and holding device located in said aperture will grip a stopper in the guide path and hold said stopper, whereafter the rotor is rotated so that the longitudinal axis of the aperture will be in line with the longitudinal axis of the bottle and the gripping and holding device moves the stopper towards the bottle and inserts said stopper into the neck of the bottle, whereafter the stopper is released and simultaneously, or subsequent to further rotation of the rotor, a subsequent aperture is aligned with the guide path and a gripping and holding device located in said further apeture seizes a following, oriented stopper in the guide path and holds said stopper and, subsequent to further rotation of the rotor, inserts the stopper in a subsequent bottle, this procedure being repeatable.

10. An apparatus according to claim 9, wherein the gripping and holding device comprises an arm which is displaceable in the direction of its longitudinal axis and which is extendable from said aperture when said aperture faces towards the guide path and grips and holds a stopper through the medium of a vacuum connection located at one end of the arm, whereafter the arm together with the stopper held thereby are drawn into the rotor aperture and the rotor is rotated so as to bring the arm and the stopper in register with a filled bottle and the arm is then moved together with the stopper towards the bottle and the stopper inserted thereinto, whereafter the stopper is released from the holding device by interrupting the vacuum, and the arm is drawn into the rotor aperture prior to further rotation of the rotor.

11. An apparatus according to claim 9, wherein the rotor has a cylindrical surface which forms part of a sphere, such that the cylinder forms a spherical zone, and is enclosed in a casing which is sealingly connected to the magazine and the stopper guide path and to the plate above the transporting system.

12. An apparatus according to claim 7, wherein the bottle stoppering station includes a plurality of parallel stoppering units such that several bottles will be stoppered simultaneously, whereafter the smaller carrousel is rotated through a part of a revolution and the remaining bottles are stoppered.

13. An apparatus according to claim 7, wherein the bottle sealing station includes a magazine for orienting sterile stoppers, and a guide path for advancing said sterile stoppers, and a device for gripping and holding the oriented stoppers one by one and subsequently inserting the stoppers into respective bottles.

14. An apparatus according to claim 1, wherein said stations are located in a cyclic treatment circuit.

15. An apparatus according to claim 14, wherein the station at which the bottles are delivered into holding devices and the station at which the bottles are withdrawn from the holding devices constitute a single station.

16. An apparatus according to claim 1, wherein said transporting system comprises a large carrousel which is arranged for intermittent rotation in the horizontal plane and which includes four positions in which between two to twelve, preferably four bottles are supported in each position; and wherein the bottles are supported in each position in a smaller carrousel also arranged for intermittent rotation in the horizontal plane.

17. An apparatus according to claim 16, wherein the larger carrousel and the smaller carrousels are located beneath a horizontal, stationary plate; and wherein the individual bottles are carried in cylindrical bottle holders which can be brought into sealing abutment with the plate stations, the treatment stages in the stations being carried out through openings located in said plate.

18. An apparatus according to claim 17, wherein the bottle filling stations is constructed such that liquid from a storage container in which the liquid level is held constant, is conducted to the bottles gravitationally through a delivery line which incorporates two sequentially arranged valves; and wherein controllable return pressure equalizing line is arranged between the liquid storage container and the space in the cylindrical bottle holding device.

19. An apparatus according to claim 15, wherein said transporting system comprises a large carrousel which is arranged for intermittent rotation in the horizontal plane and which includes four positions in which between two to twelve, preferably four bottles are supported in each position; and wherein the bottles are supported in each position in a smaller carrousel also arranged for intermittent rotation in the horizontal plane.

20. An apparatus according to claim 1, wherein the sealed space is filled with an inert gas at a pressure above atmospheric pressure.

* * * * *